US007053339B2

(12) United States Patent
Goto

(10) Patent No.: US 7,053,339 B2
(45) Date of Patent: May 30, 2006

(54) CERAMIC HEATER

(75) Inventor: Yoshinobu Goto, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 10/395,825

(22) Filed: Mar. 24, 2003

(65) Prior Publication Data

US 2003/0183616 A1 Oct. 2, 2003

(30) Foreign Application Priority Data

Mar. 28, 2002 (JP) ..... P2002-090923
Jan. 16, 2003 (JP) ..... P2003-007821

(51) Int. Cl.
*H05B 3/68* (2006.01)
*H05B 3/02* (2006.01)

(52) U.S. Cl. ..... 219/444.1; 219/546

(58) Field of Classification Search ..... 219/443.1, 219/444.1, 542, 543, 546, 547, 548; 118/724, 118/725

See application file for complete search history.

(56) References Cited

U.S. PATENT DOCUMENTS 2,409,244 A * 10/1946 Bilan ..... 219/468.1
4,538,051 A * 8/1985 Schreder et al. ..... 219/457.1
4,740,674 A * 4/1988 Tsutsumi ..... 219/523
5,264,681 A * 11/1993 Nozaki et al. ..... 219/544
5,570,690 A 11/1996 Yoon
5,573,690 A * 11/1996 Nobori et al. ..... 219/458.1
5,616,024 A * 4/1997 Nobori et al. ..... 432/241
5,683,606 A * 11/1997 Ushikoshi et al. ..... 219/544
5,753,891 A * 5/1998 Iwata et al. ..... 219/390
2002/0043528 A1* 4/2002 Ito ..... 219/444.1

FOREIGN PATENT DOCUMENTS

JP 2001-102157 4/2001

OTHER PUBLICATIONS

U.S. Appl. No. 10/998,392, filed Nov. 29, 2004, Okajima et al.

* cited by examiner

*Primary Examiner*—Sang Paik
(74) *Attorney, Agent, or Firm*—Burr & Brown

(57) ABSTRACT

A ceramic heater includes a ceramic substrate having a heating face, a resista nce heating element embedded in the substrate and a terminal electrically connected with the resistance heating element. The resistance heating element includes first and second coiled windings. The first winding has a coil diameter that is larger than the coil diameter of the second winding. A non-wound wire may also be used instead of the second winding.

19 Claims, 11 Drawing Sheets

CERAMIC HEATER

This application claims the benefits of Japanese Patent Applications P2002-90923 filed on Mar. 28, 2002, and P2003-7821 filed on Jan. 16, 2003, the entireties of which are incorporated by reference.

BACKGROUND OF THE INVENTION

1. Field of the Invention

The invention relates to a ceramic heater, for example, suitable for a system for producing semiconductors.

2. Related Art Statement

In a system for producing semiconductors, a ceramic heater may be provided for heating a wafer so as to deposit a semiconductor thin film on the wafer from gaseous raw materials such as silane gas by means of thermal CVD or the like. In such a ceramic heater, it is required to make the temperature of the heating face and the semiconductor wafer mounted thereon uniform with high precision.

Several techniques for reducing the temperature distribution on the heating (mounting) face of the ceramic heater are known. For example, a so-called two-zone heater is known. Such a two-zone heater includes a ceramic substrate and inner and outer resistance heat generators embedded in the substrate. Separate power supply terminals are connected to the respective heat generators so that electric power may be applied independently on the respective generators. Heat generated from the inner and outer heat generators may be thus independently controlled.

Such a two-zone heater includes the following. Japanese patent publication 2001-102157A discloses a heater having a ceramic substrate and two layers of heating elements embedded in the substrate. The calorific values in the inner zone and outer zone of each heating element are controlled so that two-zone control system of inner and outer zones may be realized.

SUMMARY OF THE INVENTION

When a ceramic heater is used as a susceptor for mounting a semiconductor, various functional members may be embedded in a ceramic substrate of the heater other than a resistance heater. For example, an electrode for electrostatic chuck or for generating high frequency may be embedded in the substrate. Further, various kinds of holes may be formed in the substrate. Such holes include a hole for inserting a lift pin supporting a semiconductor wafer, a hole for supplying a back side gas, and a hole for inserting a thermocouple. When the above functional members or holes are provided in the ceramic substrate, the functional members and holes constitute structural defects in the ceramic substrate. When the resistance heating element is further embedded in the substrate, it is thus necessary to provide a specific distance between the resistance heating element and the functional member or hole. The planar pattern of the embedded resistance heating element is limited by the necessity of providing the specific distance.

For example, in the ceramic heater 31 shown in FIG. 10, a winding 3C having a shape of a coil spring is embedded in a ceramic substrate 2, and both ends of the winding 3C are connected with terminals 6, respectively. Such a resistance heating element having the shape of a coil spring has a relatively large substantial diameter (winding diameter of the coil spring). It is thus possible to reduce the temperature change (reduction) in the direction of thickness of the substrate 2. Such a reduction of temperature change is advantageous for improving the temperature uniformity on the heating face of the substrate 2. It is preferred to embed the resistance heating element 3C as uniformly as possible over the whole of the heating face of the heater. The resistance heating element is shown embedded according to a planar pattern of concentric circles or a spiral pattern for this reason.

When such a resistance heating element having the shape of a coil spring is embedded for improving the temperature uniformity on the heating face, however, it is impossible to provide the resistance heating element on or near functional members and holes provided in the substrate. Such a limitation on the design of the planar pattern of the resistance heating element may cause cold spots on the heating face. The reasons are as follows. It is necessary to provide a safe distance of some degree between the hole and the resistance heating element, considering the dimensional tolerances in the processes of machining the hole and embedding the resistance heating element in the substrate. Further, it is necessary to assure proper insulation between the functional member and resistance heating element to prevent short-circuits. The insulation is decided by the distance between the functional member and resistance heating element, the shapes of the functional member and resistance heating element, and the volume resistivity of the ceramic. It is thereby necessary to provide a safe distance between the functional member and resistance heating element in the substrate. When such a safe distance is provided between the functional member and resistance heating element, however, cold spots may be observed depending on the design.

For example, in the example shown in FIG. 10, a pair of functional members 7, such as terminals for an electrode for electrostatic chuck, are positioned at a small distance. Further, in the present example, a pair of terminals 6 for a heater are positioned at a small distance. Such a design is applied for joining a tube-shaped supporting member to the central part of the back face of a heater and inserting power supply means inside of the supporting member. In this case, it is required that the terminals 6, 7 are positioned in a central part of the substrate 2. When a pair of connecting members 7 and a pair of connecting members 6 are positioned in a relatively small central part at small distances, however, it becomes difficult to embed the resistance heating element near a pair of the connecting members 7. The reason is that the distance of the connecting members 7 is too small to assure a sufficiently large space for inserting the resistance heating element therebetween. The room for inserting the resistance heating element is also small between the terminals 6 and 7. As a result, cold spots may be observed between the connecting members 7 and the surrounding region 28.

An object of the present invention is to provide a novel ceramic heater so that the temperature uniformity on its heating face may be improved and cold spots on the heating face may be effectively prevented.

The present invention provides a ceramic heater having a ceramic substrate with a heating face, a resistance heating element embedded in the substrate and a terminal electrically connected with the heating resistance. The resistance heating element includes first and second windings, and the first winding has a winding diameter that is larger than that of the second winding.

The present invention further provides a ceramic heater having a ceramic substrate with a heating face, a resistance heating element embedded in the substrate and a terminal electrically connected with the resistance heating element. The resistance heating element includes a winding and a non-wound wire.

The inventors have reached the idea that the combination of a first winding having a larger winding diameter and a second winding having a smaller winding diameter is applied as the resistance heating element embedded in a heater substrate. Further, they have reached the idea of the combination of a winding and a non-wound wire as the resistance heating element. Such structures have proved to be effective for improving the temperature uniformity on the heating face of the heater and for preventing cold spots on the heating face. The present invention is based on the discovery.

These and other objects, features and advantages of the invention will be appreciated upon reading the following description of the invention when taken in conjunction with the attached drawings, with the understanding that some modifications, variations and changes of the same could be made by the skilled person in the art.

DETAILED DESCRIPTION OF THE INVENTION

The present invention will be described further in detail, referring to the attached drawings.

Figure 1:
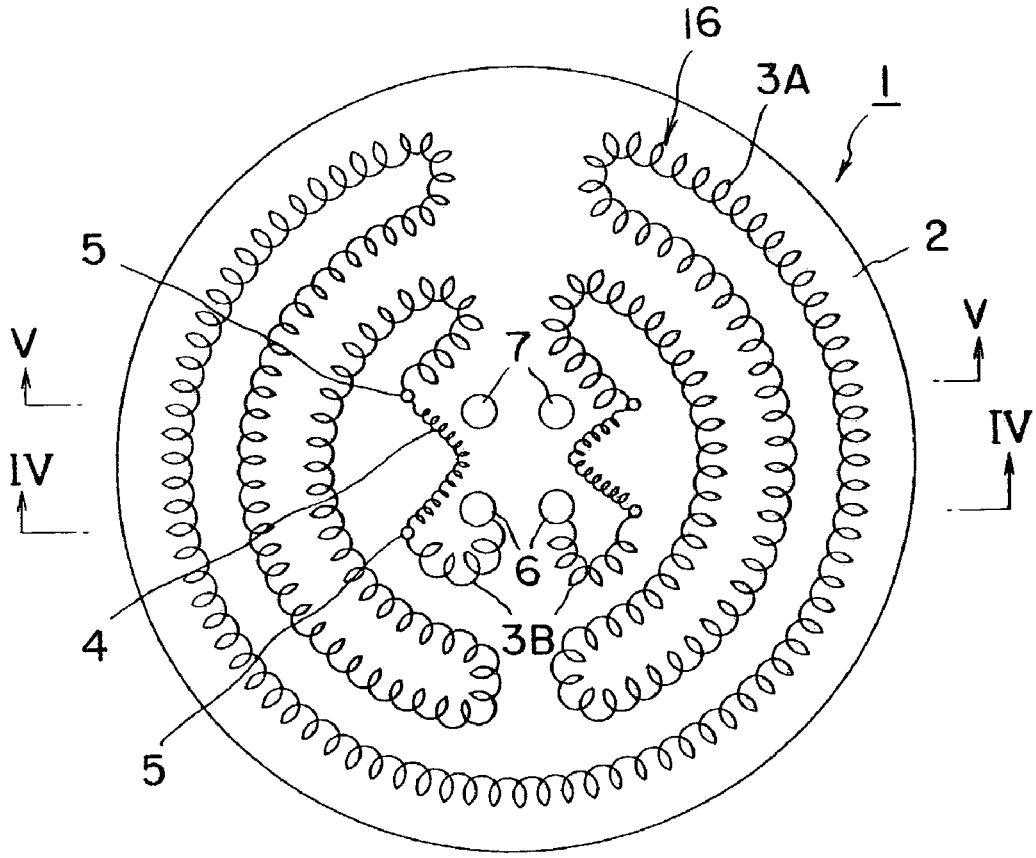
FIG. 1 is a view showing planar pattern of a heating resistance 16 embedded in a ceramic heater 1 according to one embodiment of the present invention.
Figure 2:
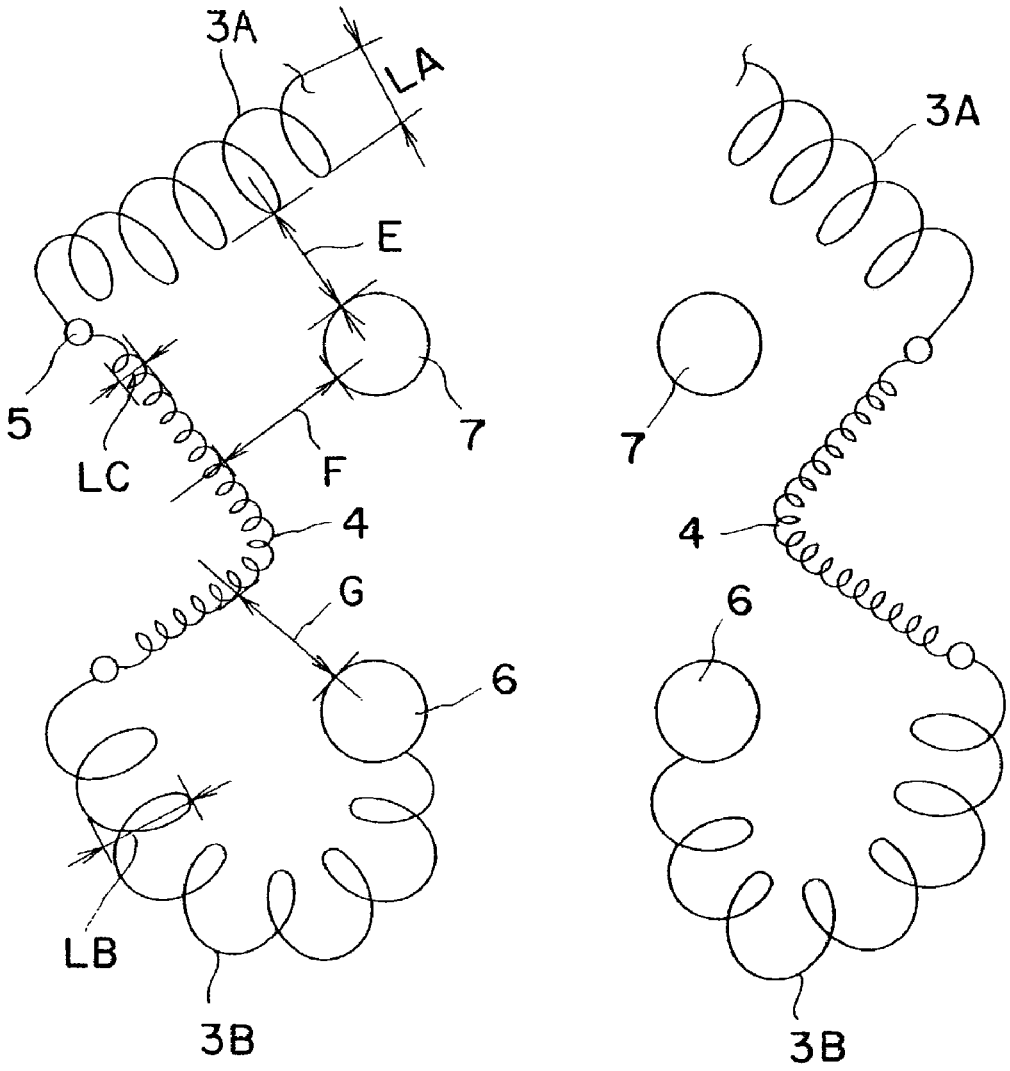
FIG. 2 is an enlarged view showing an essential part of FIG. 1.
Figure 4:
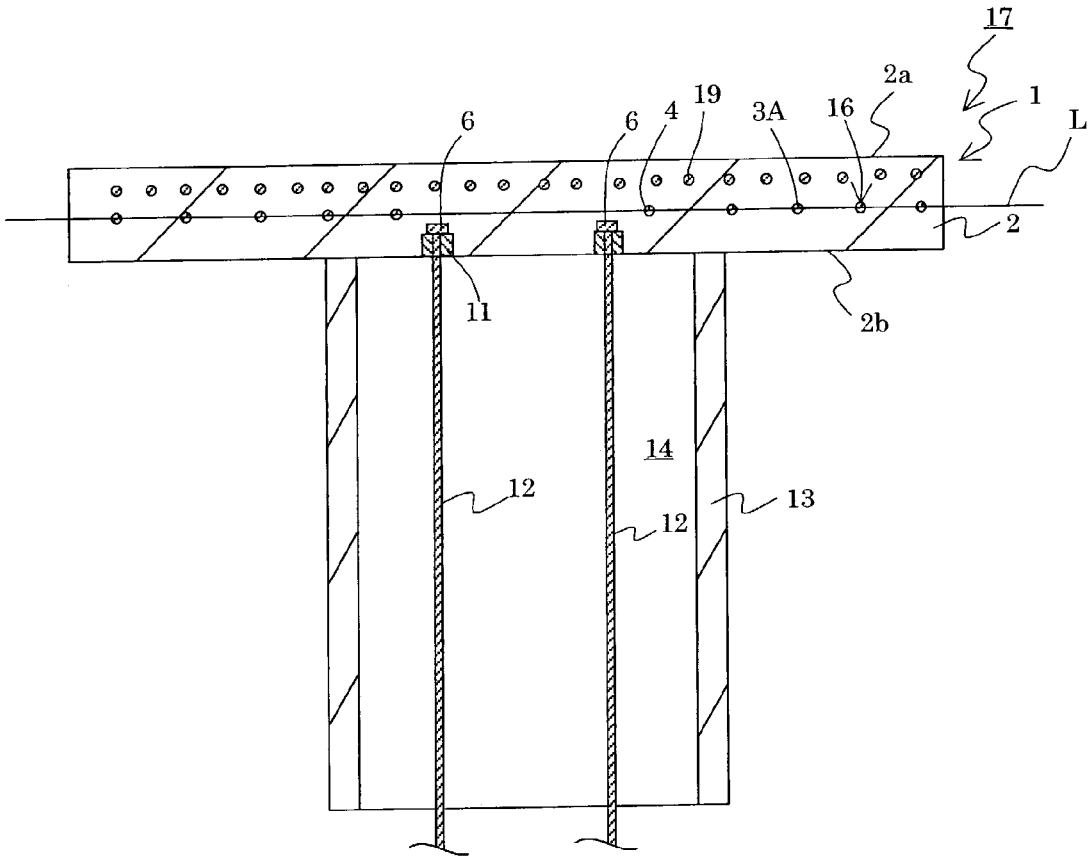
FIG. 4 is a cross sectional view, cut along a IV—IV line in FIG. 1, showing a heating system 17 having the heater of FIG. 1 and a supporting member 13.
Figure 5:
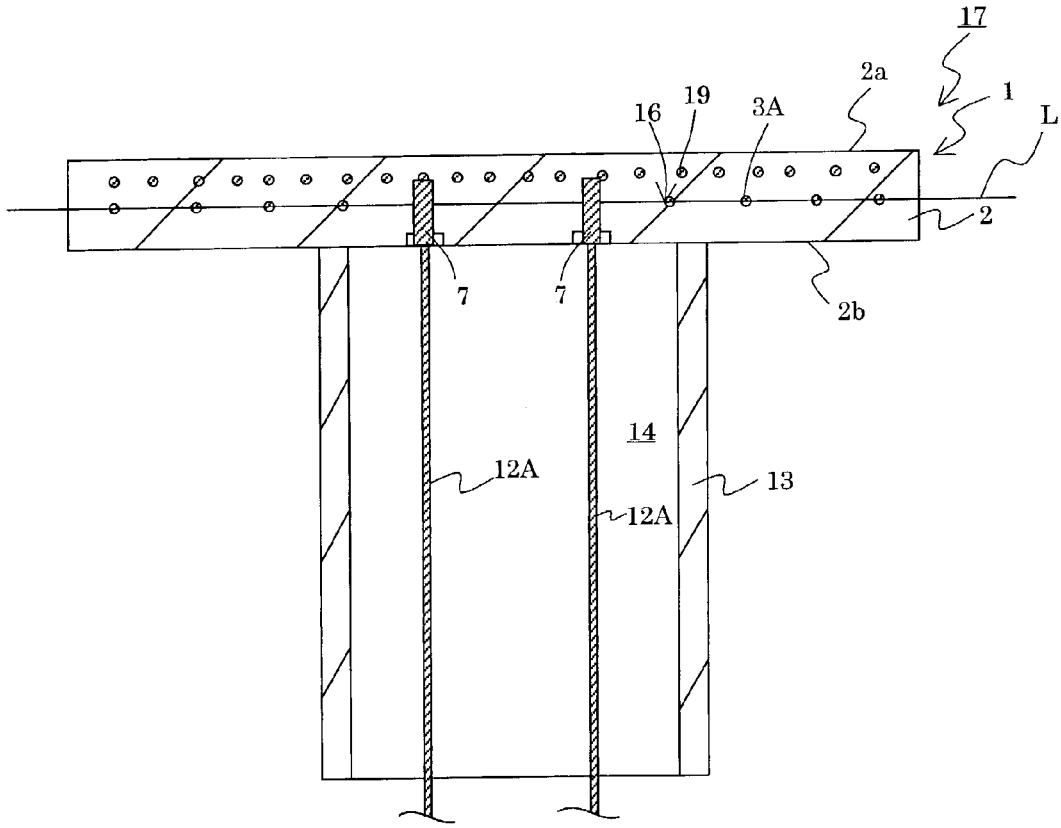
FIG. 5 is a cross sectional view, cut along a V—V line in FIG. 1, showing the heating system 17 having the heater of FIG. 1 and the supporting member 13.

FIG. 1 is a diagram showing pattern of a resistance heating element 16 embedded in a ceramic substrate 2, in a ceramic heater according to one embodiment of the present invention. FIG. 2 is an enlarged view of FIG. 1. FIGS. 4 and 5 show a heating system 17 having the ceramic heater 1 and a supporting member 13. In the heater 1, the resistance heating element is embedded in the substrate 2 and not exposed to the surface of the substrate, however, cross sectional hatching is omitted to more clearly show the planar pattern of the resistance heating element.

The whole heating system will be described first, referring to FIGS. 4 and 5. The substrate 2 substantially has a shape of a disk. Windings 3A, 4 and 3B, as well as another functional member 19, are embedded inside the substrate 2. As shown in FIG. 4, the resistance heating element 3B is connected with a power supply means 12 through terminals 6 and 11. Further, as shown in FIG. 5, the functional member 19 is connected with a power supply means 12A through the terminal 7. The functional member 19 is, for example, an electrode for an electrostatic chuck.

A hollow supporting member 13 has an end face that is joined with a back face 2*b* of the substrate 2. The joining method is not particularly limited. The joining may be carried out by soldering, fixing with bolts, or solid phase welding as described in Japanese patent publication P8-73280A. The heater and supporting member may be joined and sealed using a sealing member such as an O-ring and a metal packing. The supporting member 13 has a cylindrical shape. The supporting member 13 defines an inner space 14 separated from atmosphere in a chamber. The power supply means 12 and 12A are contained in the inner space 14.

In the present embodiment, the first wirings 3A, 3B and second winding 4 are embedded in the substrate 2 as heat generators. The first wiring 3A is embedded according to a planar pattern substantially in the shape of a spiral. Both ends of the first winding 3A are connected with the second winding 4 through the terminals, respectively. The other end of each winding 4 is connected with the first winding 3B. Each end of each winding 3B is connected with the terminal 6.

Figure 10:
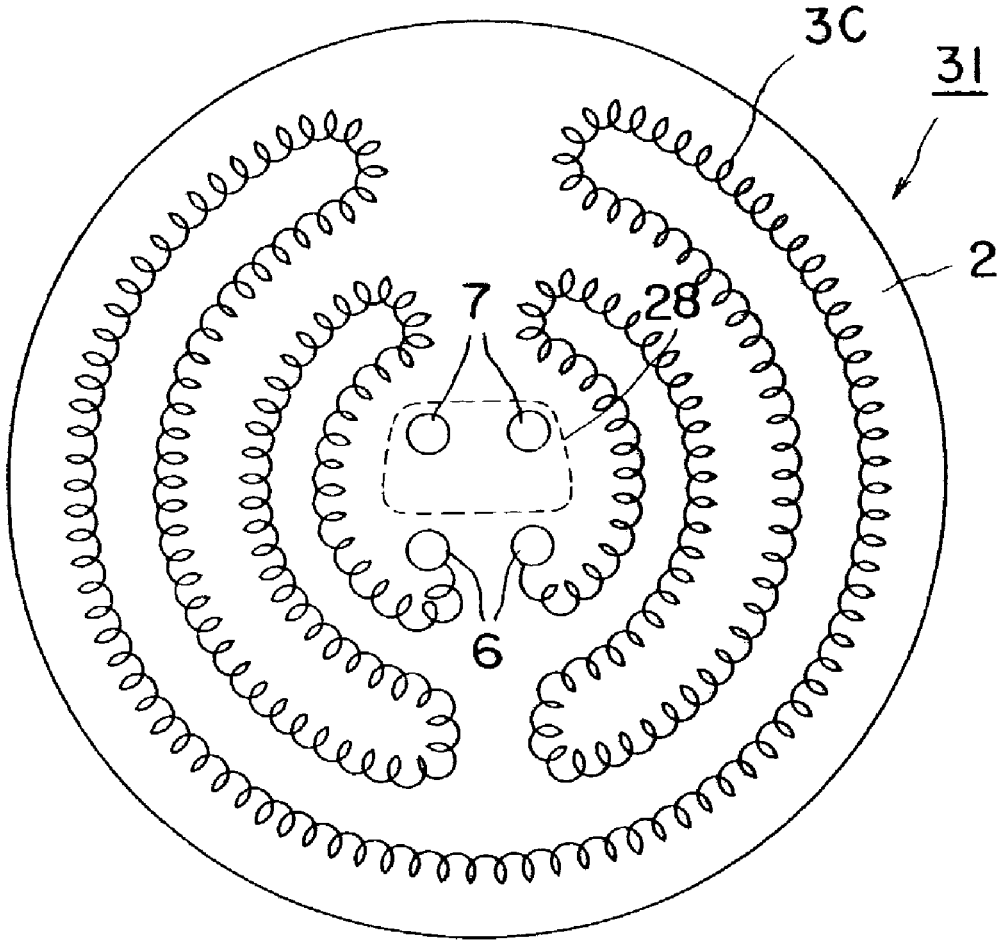
FIG. 10 is a diagram showing planar pattern of a resistance heating element embedded in a ceramic heater 31 according to a reference example.
Figure 11:
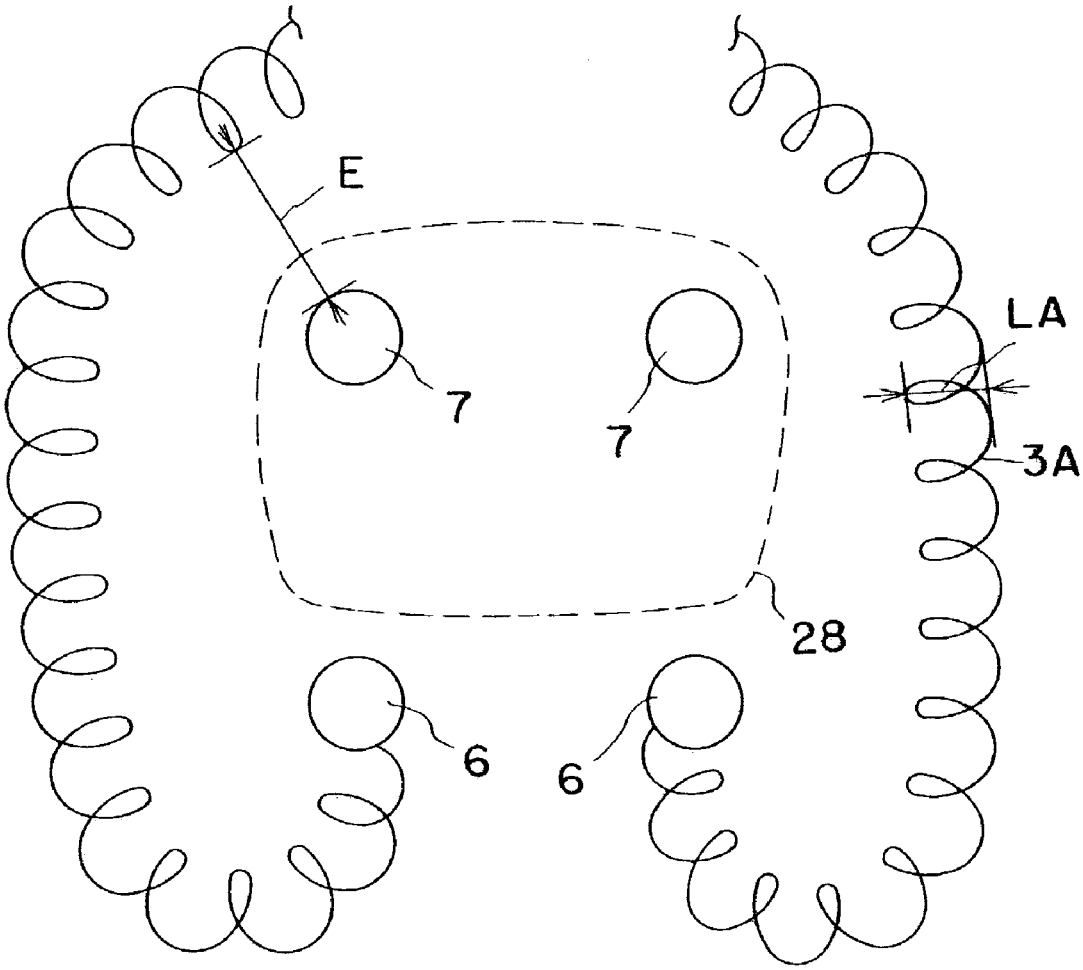
FIG. 11 is an enlarged view showing an essential part of FIG. 10.

As shown in FIG. 2, according to the present invention, the winding diameters LA, LB of the first windings 3A, 3B are made larger than the winding diameter LC of the second winding 4. The advantages will be described below. In the resistance heating element having the planar pattern shown in FIG. 10, the winding diameter LA of the heating resistance 3A is constant as shown in an enlarged view of FIG. 11. It is necessary to assure insulation and tolerance on the viewpoint of the precision of production, between the heating resistance 3A and terminal 7. It is thus demanded to provide a safety distance "E" between the resistor 3A and terminal 7. As a result, it is necessary to design the planar pattern of the resistance heating element 3A so that it is substantially distant from a pair of the terminals 7. Such a design inevitably results in cold spots 28 on the heating face.

On the contrary, according to the present invention, the winding 4 having a smaller winding diameter can be provided near a structural defect, for example the terminal 7, as shown in FIG. 2. Since the winding diameter LC of the winding 4 is small, the winding 4 may be easily bent and embedded in planar pattern such that the distances between the winding 4 and the terminals 6 and 7 are minimized, while at the same time assuring safe distances F and G. When the winding 4 has a larger winding diameter, it is difficult to bend the winding 4 so that the distances between the winding 4 and the terminals 6 and 7 are minimized. It is thus possible to cancel, or at least reduce or prevent, the cold spots 28.

Figure 3:
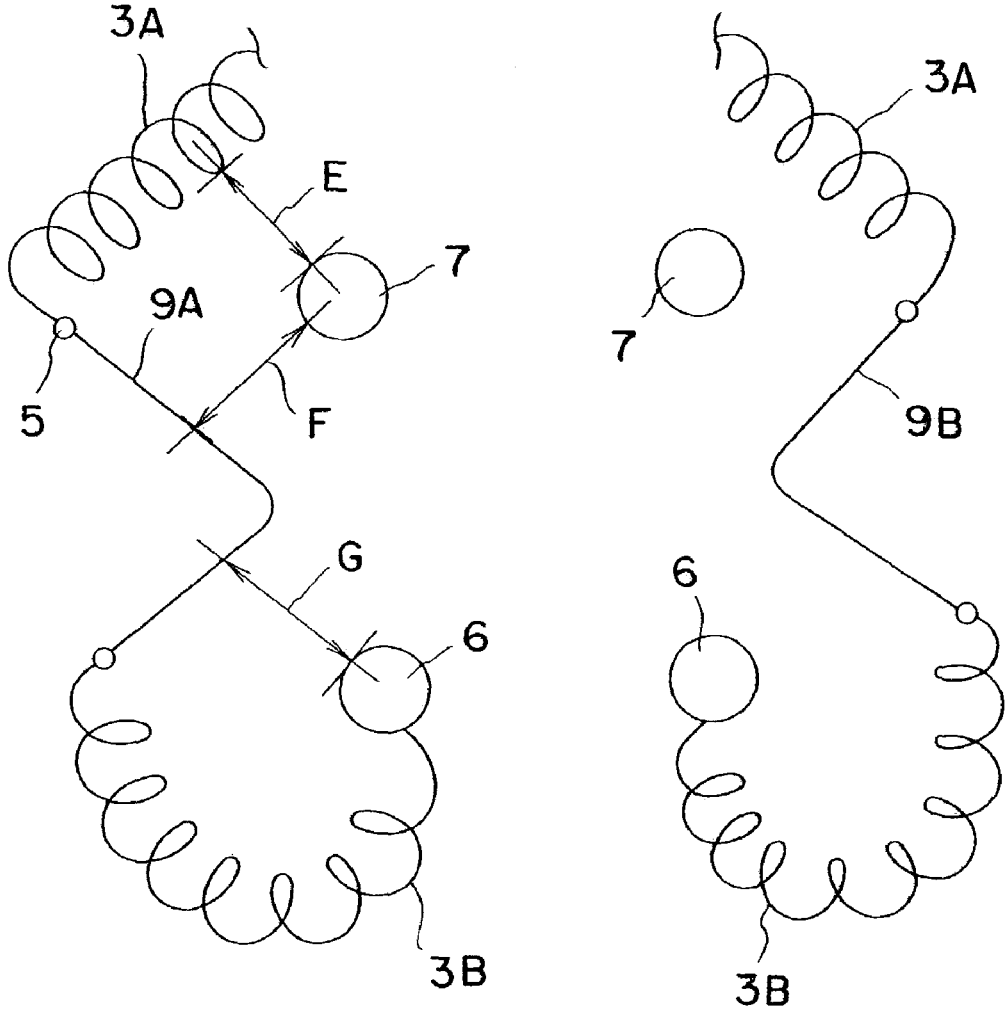
FIG. 3 is a diagram showing planar pattern of a resistance heating element according another embodiment of the present invention.

Further, in the embodiment of FIG. 3, non-wound wires 9A and 9B are used, each comprising a wire of a conductive material, instead of the second winding. Also in this case, the distances F and G between the non-wound wires 9A, 9B and the terminals 6, 7 are minimized, assuring safety distances F, G.

As the winding (i.e., coil) diameters LA and LB of the first winding is larger, the temperature change (temperature reduction) in the thickness direction of the substrate 2 may be further reduced. It is thus possible to facilitate a control for reducing the temperature distribution on the heating face 2*a*. The winding diameters LA, LB of the first winding are preferably not smaller than 1.0 mm, and more preferably, not smaller than 1.5 mm from this viewpoint. When the winding diameter of the first winding is larger, however, a thicker ceramic substrate is needed to embed the winding, so that the thermal capacity of the heater is increased. The winding diameter of the first winding is preferably not larger than 20 mm for reducing the thermal capacity of the ceramic heater.

The winding (i.e., coil) diameter LC of the second winding is preferably not larger than 10 mm, and more preferably, not larger than 5 mm from the viewpoint of the present invention. Further, the ratio of LC (winding diameter of the second winding)/LA, LB (winding diameter of the first winding) is preferably not larger than 0.9, and more preferably, not larger than 0.8 from the viewpoint of the present invention. Further, the difference between LC (winding diameter of the second winding) and LA, LB (winding diameter of the first winding) is preferably not smaller than 1 mm, and more preferably, not smaller than 2 mm from the viewpoint of the present invention.

The lower limit of the winding diameter LC of the second winding is not particularly defined and is preferably not smaller than 0.5 mm to facilitate mass production.

In a preferred embodiment, as shown in FIGS. 1 to 3, the substrate includes a structural defect 7. The term structural defect means a part in the substrate in which an object that is different from the ceramic constituting the substrate, a space or hollow is provided. Such an object includes a ceramic that is different from the ceramic constituting the substrate, a metal (including an alloy) and a composite material of a metal and ceramics. More specifically, such an object includes a terminal, a conductive connection part, an electrode for generating high frequency, an electrode for an electrostatic chuck and a thermocouple. The space or hollow includes a hole for inserting a lift pin, and a hole for supplying back side gas.

The distances F and G between the second winding or non-wound wire and structural defect are preferably not larger than 40 mm, and more preferably, not larger than 30 mm, to reduce cold spots. When the distance between the second winding or non-wound wire and structural defect is too small, the insulating property is reduced or the tolerance of design might not be assured. The sufficient safety distance to secure the insulation is decided by the conductivity of the ceramic constituting the substrate and the usage temperature of the heater. Each of the distances F and G between the second winding or non-wound wire and structural defect are preferably not smaller than 1 mm, and more preferably, not smaller than 2 mm, from this viewpoint.

The first winding and second winding or non-wound wire may be directly connected or preferably be connected through a terminal. In this embodiment, the winding and terminal, or non-wound wire and terminal, may be joined by means of a method not particularly limited including winding to a screw portion, caulking, fitting, soldering, welding or eutectic welding.

The ceramic material of the substrate for the heater is not particularly limited. The material for the substrate may be a known ceramic material including nitride ceramics such as aluminum nitride, silicon nitride, boron nitride and sialon, and an alumina-silicon carbide composite material. Aluminum nitride or alumina is most preferred for providing excellent anti-corrosion property against a corrosive gas such as a halogen based corrosive gas.

The shape of the substrate is not particularly limited and may preferably be disc-shaped. Pocket shaped parts, emboss-shaped parts, or grooves may be formed on the heating face.

The method of producing the substrate is not particularly limited, and the substrate is preferably produced by hot pressing and hot isostatic pressing.

The material for the resistance heating element is preferably tantalum, tungsten, molybdenum, platinum, rhenium, hafnium or the alloys of these metals. In particular, when the ceramic substrate is made of aluminum nitride, the material of the resistance heating element is preferably pure molybdenum or an alloy containing molybdenum. The material of the resistance heating element may be a conductive material such as carbon, TiN or TiC, in addition to the high melting point metals described above.

The wire diameters of the first and second windings may be decided depending on the required supply of calorific value, winding (coil) diameter, thermal conductivity and shape of the substrate. Generally, the wire diameter is preferably 0.05 to 3 mm. The wire diameter of the non-wound wire is preferably not smaller than 0.1 mm for facilitating the connection of the wire to the terminal. Further, the diameter of the non-wound wire is preferably not larger than 2 mm to supply energy of a reasonable calorific value through the non-wound wire and to reduce cold spots.

The material of the terminal electrically connected with the resistance heating element is preferably the same material used for the resistance heating element described above.

The application of the heater according to the present invention is not limited, and may preferably be used for a system for producing semiconductors. Such a semiconductor producing system means a system that is used in a wide variety of semiconductor processing in which metal contamination of a semiconductor is to be avoided. Such systems include film forming, etching, cleaning and testing systems.

The shape of each power supply means is not particularly limited, and may include a rod shaped body, a wire shaped body or a combination of rod and wire shaped bodies. The material for each power supply means is not particularly limited. The power supply means is separated from the atmosphere in a chamber and thus is not directly exposed to a highly corrosive substance. The material of the supply means is thus preferably a metal, and most preferably, nickel.

Each resistance heating element does not necessarily have a planar pattern composed of one continuous line without branching or coupling between the corresponding terminals. Each heating resistance may have an electrical branching part or coupling part between the terminals.

In a preferred embodiment, the first and second windings (or non-wound wire) are embedded along a plane "L" that is substantially parallel with the heating face 2*a* (see FIGS. 4 and 5). The advantages of the present invention is most considerable in this case. In this embodiment, it is required that the plane "L" passes through at least a part of each heating resistance. It is not required that the geometrical center of each heating resistance is on the plane "L" in a geometrically strict meaning. In addition to this, the central plane of each resistance heating element may be dislocated from the plane "L" due to any reasons including manufacturing error, allowance or tolerance.

In a preferred embodiment, each resistance heating element is provided so that the resistance heating element is substantially parallel with the heating face 2*a*. It is thus possible to further improve the temperature uniformity on the heating face 2*a*. In this embodiment, the resistance heating element may be parallel with the heating face in a geometrically strict meaning. Alternatively, the resistance heating element may be positioned to intersect the heating face 2*a* at a sufficiently small angle, such as −0.5 to +0.5 degree. Furthermore, a tolerance in the manufacturing process may be allowed.

In a preferred embodiment, at least a pair of structural defects are provided in the substrate and the second winding or non-wound wire passes through the structural defects. That is, when at least a pair of the structural defects are provided in the substrate, it is difficult to provide a sufficiently large space between the structural defects. Cold spots may be often observed on the heating face between the structural defects. For example, in the example shown in FIG. 10, cold spots may be often observed between a pair of the structural defects 7 or between the structural defects 6 and 7.

When the distance between the structural defects is small, however, it is difficult to provide a winding having a normal size between the structural defects due to the limitation on the design described above. According to the present invention, the non-wound wire or second winding having a smaller winding diameter is inserted between the structural defects. In addition to this, the first winding having a larger winding diameter may be used in the other region at the same time. It is thus possible to prevent cold spots mainly observed in the region between the structural defects.

Figure 6:
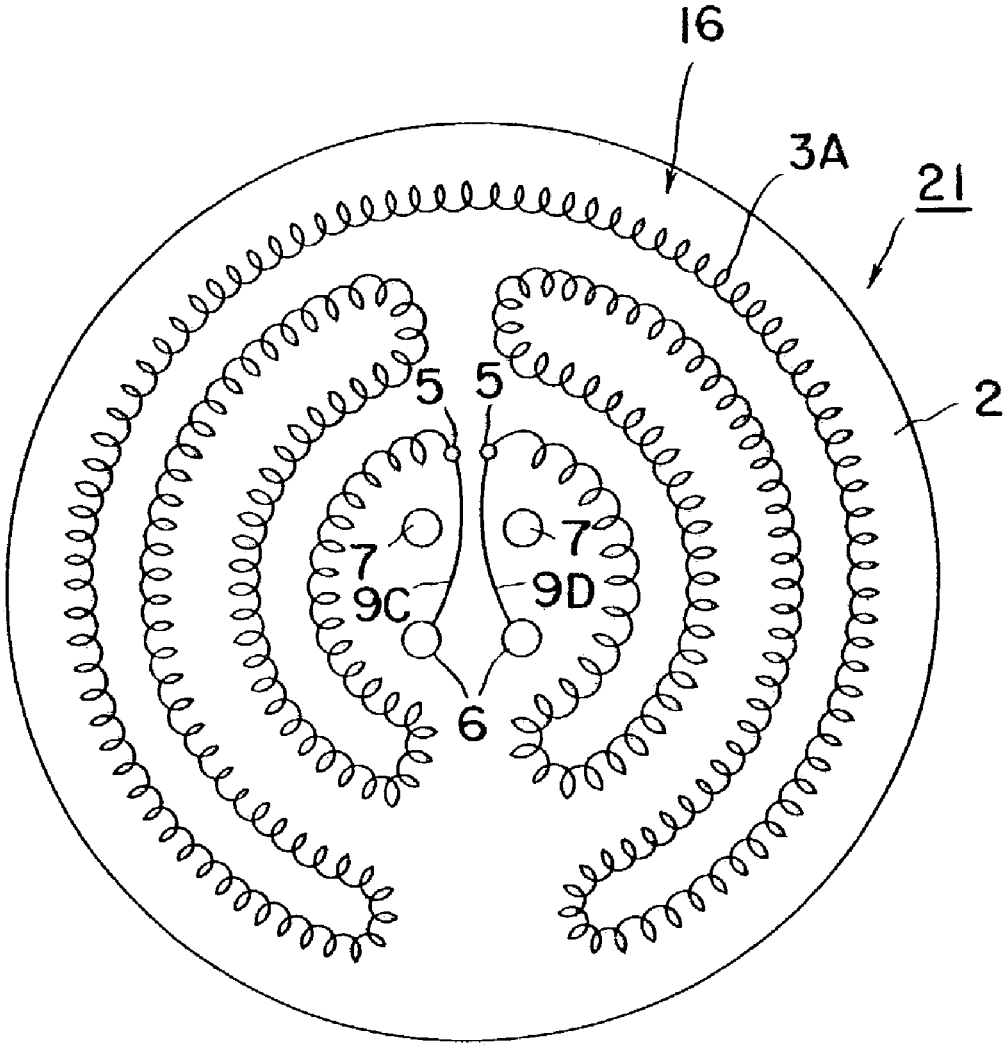
FIG. 6 is a diagram showing planar pattern of a resistance heating element 16 in a heater 21 according to another embodiment of the present invention.
Figure 7:
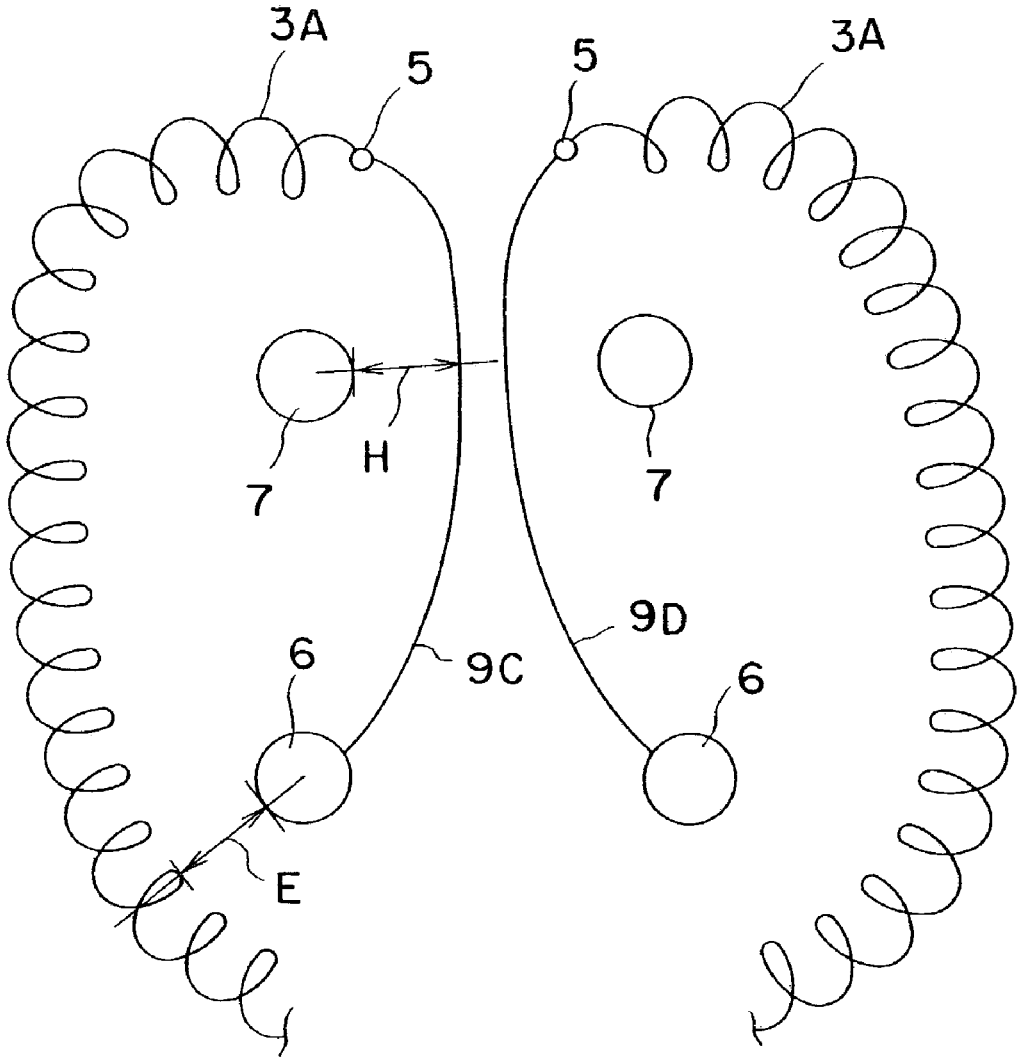
FIG. 7 is an enlarged view showing an essential part of planar pattern of the resistance heating element in FIG. 6.

FIG. 6 is a diagram showing planar pattern of embedded resistance heating element 16 and terminals 6, 7, and FIG. 7 is an enlarged view of them.

In the present example, a winding 3A and non-wound wires 9C and 9D are embedded in the substrate 2 of a ceramic heater 21. The winding 3A and non-wound wires 9C, 9D are connected through a terminal 5. Each end of each of the non-wound wires 9C, 9D is connected with each terminal 6. As shown in FIG. 7, each of the non-wound wires 9C, 9D passes through a pair of the terminals 7 and is then connected with the corresponding terminals 6. It is required that the distance "H" between each of the non-wound wires 9C, 9D and each terminal 7 is not smaller than the safe distance described above. The non-wound wire may be replaced by the second winding having a smaller winding diameter.

In a preferred embodiment, the non-wound wire or second winding may be bent or curved in the thickness direction of the substrate. For example, in the example shown in FIG. 8, the first winding 3 is formed along the plane "L" substantially parallel with the heating face 2*a* of the substrate 2. The non-wound wire 9 is bent toward the heating face 2*a* and back face 2*b* from the plane "L" in the thickness direction. The advantages are as follows.

When the non-wound wire is elongated along the plane "L", the distance between the non-wound wire 9 and heating face 2*a* and the distance between the wire 9 and back face 2*b* are relatively large. A temperature gradient may often be induced between the wire 9 and heating face 2*a* and wire 9 and back face 2*b* so that temperature distribution on the heating face may be increased. The non-wound wire 9 is bent in the thickness direction of the substrate 2 so as to reduce the temperature distribution in the direction of thickness thereof.

Figure 8:
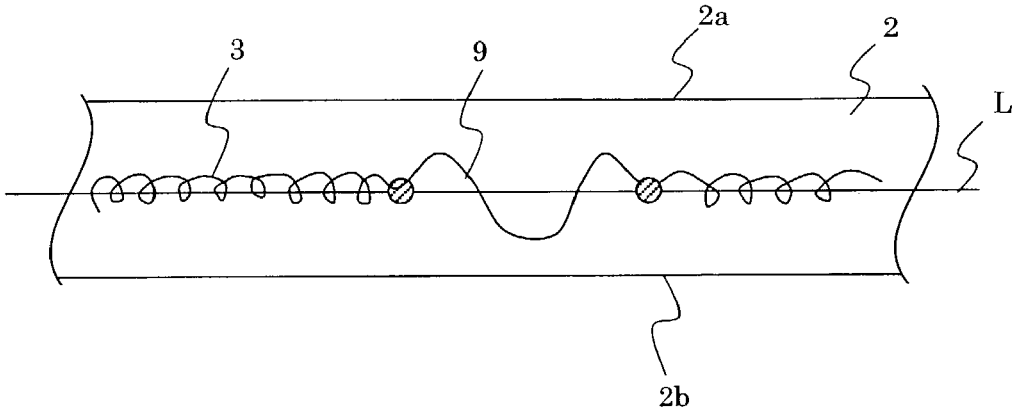
FIG. 8 is a diagram showing pattern of a winding 3 and non-wound wire 9 (pattern cut along a line in the direction of thickness of the substrate 2, in still another embodiment of the present invention.

The non-wound wire 9 used in the above example described referring to FIG. 8 may be replaced with the second winding having a smaller winding diameter.

Two kinds of windings are embedded in the substrate in the above examples. In the present invention, three or more kinds of windings having three or more kinds of winding diameters may be embedded in a single substrate. It is thus possible to control the temperature distribution on the heating face more accurately depending on the actual design of the heater, so that the tolerance of the design may be further improved.

Figure 9:
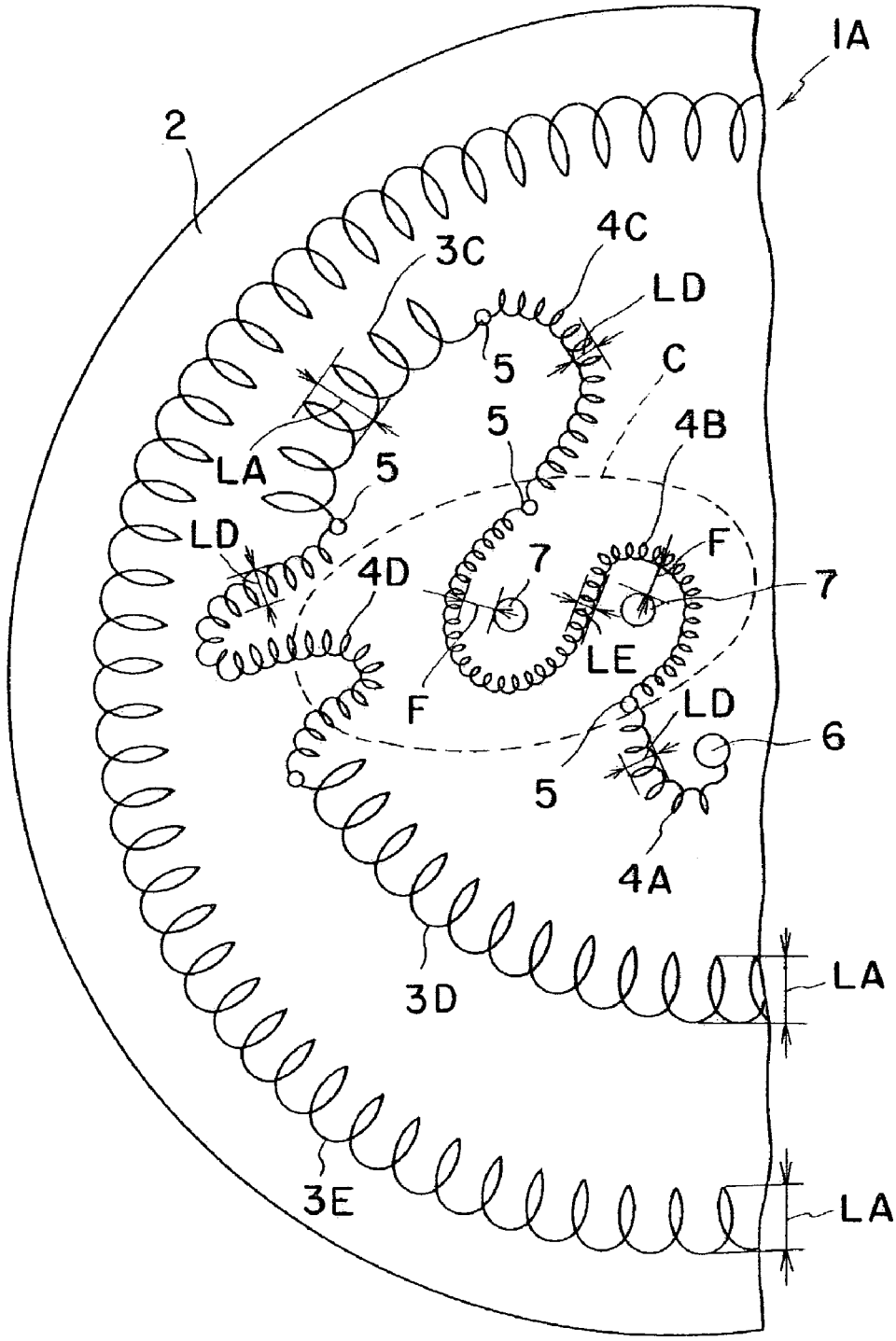
FIG. 9 is a plan view showing pattern of windings embedded in a heater according to another embodiment of the invention, in which the windings have three winding diameters LA, LD and LE, respectively.

FIG. 9 is a view showing planar pattern of embedded windings in a heater according to this embodiment. In this figure, the left half of the planar pattern of the windings is shown. The planar pattern is substantially identical in the remaining right half. In a heater 1A of the present example, the terminal 6 and a pair of the structural defects 7 are provided in the substrate 2. Cold spots may be easily induced in the region of the defects 7 and their surrounding region C.

In the present example, the outermost winding 3E and the inner windings 3D and 3C have a larger winding diameter LA. These windings are smoothly curved and substantially arc-shaped so that they are easily deformed and bent even when the winding diameter LA is relatively large. It is rather advantageous to increase the winding diameter to supply calorific power over a wider area to improve the temperature uniformity on the heating face.

On the other hand, windings 4B are formed so that the windings 4B pass through a pair of the structural defects 7 and surrounding the defects 7, respectively. As described above, it is necessary to minimize the winding diameter LE of the winding 4B for assuring a safety distance "F" near the defect 7.

Further, in the present example, a winding 4A having a winding diameter LD is provided between the winding 4B having the smallest winding diameter LE and the terminal 6. A winding 4C having a winding diameter LD is provided between the windings 4B and 3C. The regions where the windings 4A, 4C are provided are distant from the structural defects 7. It is thus desirable to increase the winding diameter LD for supplying calorific power in a wider area. In the regions, however, the curvature is relatively large. It becomes thus difficult to smoothly bend the windings 4A and 4C when the winding diameter LA is increased so that the possibility of breaking the wire and causing current concentration may be increased. The winding diameter LD of the windings 4A and 4C is adjusted at a value between the winding diameters LE and LA.

In the planar pattern of the present example, cold spots may be easily induced on the heating face in the region of the structural defect 7 and the surrounding region as described above. In the present example, the winding 4D is bent and curved in the region surrounding the defect 7 so that the calorific value is increased to reduce the cold spots. When the winding 4D is bent, however, the curvature is increased. The winding diameter LD of the winding 4D is reduced compared with the winding diameter LA to facilitate deformation of the winding 4D.

Further in the present embodiment, windings having four kinds of winding diameters may be provided. It is also possible to replace the winding 4B surrounding the defect 7 with a non-wound wire.

EXAMPLES

The heating system 17 shown in FIGS. 1, 2, 4 and 5 was produced. The substrate 2 was made of an aluminum nitride sintered body having a diameter ϕ of 350 mm and a thickness of 20 mm. The windings 3A, 3B and 4 were embedded in the substrate 2. The windings 3A and 3B had winding diameters LA and LB of 8 mm and the winding 4 had a winding diameter LC of 2 mm. The windings 3A and 3B had wire diameters of 0.4 mm and the winding 4 had a wire diameter of 0.1 mm. The terminal 5 was composed of a metal member for caulking. The distance "E" between the terminals 6, 7 and first winding was 3 mm. The distances "G" and "F" between the second winding 4 and terminals 6, 7 were 3.5 mm. The windings 3A, 3B and 4 were made of molybdenum metal. The terminals 6 and 7 were composed of cylindrical terminals made of molybdenum metal.

The supporting member 13 was composed of an aluminum nitride sintered body. The supporting member 13 had an outer diameter of 80 mm, an inner diameter of 50 mm, and a length of 250 mm. The supporting member 13 was joined with the back face 2*b* of the central part of the substrate 2 by means of solid phase welding. The electrical supply means 12 and 12A composed of nickel rods were inserted into the inner space 14 of the supporting member 13 and electrically connected with each of the terminals.

The temperature of the ceramic heater was elevated so that the average temperature on the heating face 2*a* was about 700° C. The temperature distribution on the heating face 2*a* was observed by a thermoviewer. As a result, the cold spot 28 shown in FIG. 10 were disappeared. A difference between the maximum and minimum temperatures on the heating face proved to be 2° C.

As described above, the present invention provides a structure that is effective for improving the temperature uniformity on the heating face of a heater and preventing cold spots on the heating face.

The present invention has been explained referring to the preferred embodiments. However, the present invention is not limited to the illustrated embodiments which are given by way of examples only, and may be carried out in various modes without departing from the scope of the invention.

The invention claimed is:

1. A ceramic beater comprising a ceramic substrate having a heating face, a resistance heating element embedded in said substrate, and a terminal electrically connected with said resistance heating element, said resistance heating element including at least two first coiled windings and a second coiled winding, said first windings having a coil diameter that is larger than a coil diameter of said second winding, a first connecting terminal connecting one of said first coiled windings and said second coiled winding, and a second connecting terminal connecting another of said first coiled windings and said second coiled winding.

2. The ceramic heater of claim 1, wherein said substrate further includes at least one structural defect and wherein a distance between said structural defect and said second winding is not larger than 40 mm.

3. The ceramic heater of claim 2, wherein said distance between said structural defect and said second winding is not smaller than 2 mm.

4. The ceramic heater of claim 1, wherein said first and second windings are provided along a plane that is substantially parallel with said heating face of said substrate.

5. A susceptor for mounting a semiconductor comprising the ceramic heater of claim 1.

6. The ceramic heater of claim 2, wherein said substrate further includes at least two of said structural defects, and wherein said second winding passes through a space provided between said structural defects.

7. A ceramic heater comprising a ceramic substrate having a heating face, a resistance heating element embedded in said substrate, a terminal electrically connected with said resistance heating element, said resistance heating element including at least two coiled windings, at least one non-wound wire, a first connecting terminal connecting one of said coiled windings and said non-wound wire, and a second connecting terminal connecting another of said coiled windings and said non-wound wire;

wherein said coiled windings and said non-wound wire are provided along a plane that is substantially parallel with said heating face of said substrate; and wherein said non-wound wire is provided between said one and said another of said coiled windings.

8. The ceramic heater of claim 7, wherein said substrate further includes at least one structural defect and wherein a distance between said structural defect and said non-wound wire is not larger than 40 mm.

9. The ceramic heater of claim 8, wherein said distance between said structural defect and said non-wound wire is not smaller than 2 mm.

10. A susceptor for mounting a semiconductor comprising the ceramic heater of claim 7.

11. The ceramic heater of claim 8, wherein said substrate further includes at least two of said structural defects, and wherein said non-wound wire passes through a space provided between said structural defects.

12. A ceramic heater comprising a ceramic substrate having a heating face and including at least one structural defect, a resistance heating element embedded in said substrate and a terminal electrically connected with said resistance heating element, wherein said resistance heating element includes a coiled winding and a non-wound wire, wherein said coiled winding and said non-wound wire are provided along a plane that is substantially parallel with said heating face of said substrate, and wherein a distance between said structural defect and said non-wound wire is not larger than 40 mm.

13. The ceramic heater of claim 12, wherein said distance between said structural defect and said non-wound wire is not smaller than 2 mm.

14. The ceramic heater of claim 12, wherein said substrate further includes at least two of said structural defects, and wherein said non-wound wire passes through a space provided between said structural defects.

15. A ceramic heater comprising a ceramic substrate having a heating face and at least one structural defect, a resistance heating element embedded in said substrate and a terminal electrically connected with said resistance heating element, said resistance heating element including at least two coiled windings and at least one non-wound wire, said coiled windings and said non-wound wire being provided along a plane that is substantially parallel with said heating face of said substrate, and said non-wound wire being provided between two of said coiled windings, wherein a distance between said structural defect and said non-wound wire is not larger than 40 mm.

16. The ceramic heater of claim 15, wherein said distance between said structural defect and said non-wound wire is not smaller than 2 mm.

17. The ceramic heater of claim 15, wherein said substrate includes at least two of said structural defects, and wherein said non-wound wire passes through a space provided between said structural defects.

18. A ceramic heater comprising a ceramic substrate having a heating face and a plurality of structural defects formed therein, a resistance heating element embedded in said substrate, and a terminal electrically connected with said resistance heating element, said resistance heating element including a first coiled winding, a second coiled winding, and a connecting terminal connecting said first coiled winding and said second coiled winding, said first coiled winding having a coil diameter that is larger than a coil diameter of said second winding;

wherein said second coiled winding passes through a space provided between said structural defects and wherein said first coiled winding does not pass through said space.

19. A ceramic heater comprising a ceramic substrate having a heating face and a pair of structural defects formed therein, a resistance heating element embedded in said substrate, and a terminal electrically connected with said resistance heating element, said resistance heating element including a coiled winding, a non-wound wire, and a connecting terminal connecting said coiled winding and said non-wound wire;

wherein said non-wound wire passes through a space provided between said structural defects and wherein said coiled winding does not pass through said space.

* * * * *

UNITED STATES PATENT AND TRADEMARK OFFICE

CERTIFICATE OF CORRECTION

PATENT NO. : 7,053,339 B2
APPLICATION NO. : 10/395825
DATED : May 30, 2006
INVENTOR(S) : Yoshinobu Goto It is certified that error appears in the above-identified patent and that said Letters Patent is hereby corrected as shown below:

Column 9

*Line 43*: please change "beater" to --heater--

Signed and Sealed this

Twelfth Day of September, 2006

JON W. DUDAS
*Director of the United States Patent and Trademark Office*